US010377537B2

(12) United States Patent
Rigel

(10) Patent No.: US 10,377,537 B2
(45) Date of Patent: Aug. 13, 2019

(54) SMOOTH POUR DIRECTIONLESS LIQUID DISPENSER

(71) Applicant: Jumpn'Pour Ltd., Or Yehuda (IL)

(72) Inventor: Doron Rigel, Moshav Aviel (IL)

(73) Assignee: Jumpn'Pour Ltd., Or Yehuda (IL)

( * ) Notice: Subject to any disclaimer, the term of this patent is extended or adjusted under 35 U.S.C. 154(b) by 0 days.

(21) Appl. No.: 15/576,309

(22) PCT Filed: May 24, 2016

(86) PCT No.: PCT/IL2016/050538

§ 371 (c)(1),
(2) Date: Nov. 22, 2017

(87) PCT Pub. No.: WO2016/189528

PCT Pub. Date: Dec. 1, 2016

(65) Prior Publication Data

US 2018/0208369 A1 Jul. 26, 2018

Related U.S. Application Data

(60) Provisional application No. 62/166,157, filed on May 26, 2015.

(51) Int. Cl.

| | |
|---|---|
| ***B65D 47/32*** | (2006.01) |
| ***B65D 47/06*** | (2006.01) |
| ***B65D 25/44*** | (2006.01) |

(52) U.S. Cl.

CPC ..... *B65D 47/32* (2013.01); *B65D 25/44* (2013.01); *B65D 47/061* (2013.01); *B65D 2205/00* (2013.01); *B65D 2517/0049* (2013.01)

(58) Field of Classification Search

CPC .... B65D 25/42; B65D 25/44; B65D 2205/00; B65D 2517/0049; B65D 47/36;

(Continued)

(56) References Cited

U.S. PATENT DOCUMENTS 2,695,736 A * 11/1954 Punte ..... B65D 47/061 222/489

2,785,839 A 3/1957 Du Pree (Continued)

FOREIGN PATENT DOCUMENTS

| | | |
|---|---|---|
| GB | 2055088 | 2/1981 |
| GB | 2055772 | 3/1981 |

(Continued)

OTHER PUBLICATIONS

International Preliminary Report on Patentability dated Aug. 18, 2017 From the International Preliminary Examining Authority Re. Application No. PCT/IL2016/050538. (17 Pages).

(Continued)

*Primary Examiner* — Paul R Durand
*Assistant Examiner* — Andrew P Bainbridge

(57) ABSTRACT

A liquid dispenser (10) for a container of liquid, comprises a spout (12) and a liquid uptake structure (18) aligned to provide liquid to the spout from a container. The liquid uptake structure has first openings (20) radially distributed at the spout end, second openings radially distributed around the container end and a third opening centrally located at the container end. The liquid uptake structure provides an airflow path through the second openings and a principle liquid flow path separate from the airflow path through the third opening, thus separating the two flow paths and providing a smooth pour.

15 Claims, 9 Drawing Sheets

(58) Field of Classification Search
CPC .... B65D 47/38; B65D 47/061; B65D 47/063; B65D 47/065; B65D 47/32
USPC ..... 222/482, 519–532, 537, 540
See application file for complete search history.

(56) References Cited

U.S. PATENT DOCUMENTS 3,040,938 A 6/1962 Smith
3,217,935 A * 11/1965 Burt ..... B65D 47/061 222/109
4,105,141 A * 8/1978 Lane ..... B65D 47/10 222/143
4,295,583 A * 10/1981 Schurr ..... B65D 47/063 222/478
4,568,006 A * 2/1986 Mueller ..... B65D 47/063 222/478
5,005,726 A * 4/1991 Robbins ..... B29C 49/54 220/495.05
6,454,137 B1 * 9/2002 Sturk ..... B65D 47/043 222/189.09
6,976,610 B2 * 12/2005 Rigel ..... B65D 47/061 141/308
8,430,279 B2 * 4/2013 Rigel ..... B65D 51/18 222/567
8,814,004 B2 * 8/2014 Letica ..... B65D 47/063 222/153.06
9,108,771 B2 * 8/2015 Sturk ..... B29C 45/1615
9,669,972 B2 * 6/2017 Stratton ..... B65D 25/40
9,908,669 B2 * 3/2018 Stratton ..... B65D 47/32

FOREIGN PATENT DOCUMENTS

WO WO 2014/181337 11/2014
WO WO 2016/189528 12/2016

OTHER PUBLICATIONS

International Search Report and the Written Opinion dated Sep. 15, 2016 From the International Searching Authority Re. Application No. PCT/IL2016/050538.
Written Opinion dated Apr. 24, 2017 From the International Preliminary Examining Authority Re. Application No. PCT/IL2016/050538. (8 Pages).

* cited by examiner

SECTION A-A
SCALE 2:1

SMOOTH POUR DIRECTIONLESS LIQUID DISPENSER

RELATED APPLICATIONS

This application is a National Phase of PCT Patent Application No. PCT/IL2016/050538 having International filing date of May 24, 2016, which claims the benefit of priority under 35 USC § 119(e) of U.S. Provisional Patent Application No. 62/166,157 filed on May 26, 2015. The contents of the above applications are all incorporated by reference as if fully set forth herein in their entirety.

FIELD AND BACKGROUND OF THE INVENTION

The present invention, in some embodiments thereof, relates to a smooth pour directionless liquid dispenser and, more particularly, but not exclusively, to such a dispenser that is easy to mould and which can be fixed onto cans or bottles using legacy machinery.

U.S. Pat. No. 6,026,994 to the present inventor, describes a retractable spout assembly for application to the neck of a bottle to be closed by a cap. The assembly includes a sleeve-like housing fixedly receivable within the bottle neck, and a spout movable within the housing from a retracted position, when the housing is fixed within the bottle neck and the bottle neck closed by the cap, to an extended position projecting outwardly of the housing and the bottle neck for pouring out contents of the bottle. To make the spout automatically extendible upon removing the cap, the assembly further includes a spring biasing the spout to its extended position. Such a spring could be omitted, whereupon the spout would be manually movable to its extended position upon removal of the cap.

In either case, the retractable spout assembly further includes an air-return passageway for returning air into the bottle when its contents are being poured out through the spout.

Prior U.S. Pat. No. 6,976,610, also to the present inventor, describes improvements in the construction of that retractable spout assembly which not only make the assembly more compact in construction and more reliable in operation but, by including a connector disc, also enable the assembly to be accommodated by existing bottle-capping machines so that virtually no change is required in such expensive machines to enable them also to be used for applying caps incorporating retractable spout assemblies.

There are many flowable materials, however, that are provided not in bottles, but rather in cans or other similar type containers, such as those including cylindrical sidewalls closed at their opposite ends by end walls. In order to dispense contents from the container, it is necessary to puncture one of the end walls. For this purpose, the end walls to be punctured is generally provided with a tab which is to be grasped and forcibly moved in order to puncture the end wall. Previously, such tabs were forcibly pulled out of the end wall to form the opening, but for health and safety purposes at the present time such tabs are merely pivoted to puncture the end wall and remain attached to the end wall. In either case, considerable force is needed in order to puncture the end wall, and moreover, when the end wall has thus been punctured, the container can no longer be reclosed.

A can spout that allows the can to be reclosed, is discussed in International Patent Application No. PCT/IL2014/050415. A spout is typically positioned near the periphery of the end wall (off-center) to facilitate smooth, continuous and controlled flow from the spout. The off-center position improves air inflow through the spout when the can is tilted for pouring. A can-type spout assembly which includes an integrated air inflow tube circumferentially offset from the pouring end of the spout is described. The spout assembly can be rotated within an opening in an end wall of the can to position the pouring end of the spout while maintaining the offset between the spout and air return passageway thereby maximizing air inflow into the container during pouring. The reason for making the spout rotatable is that the air intake needs to be above the liquid level when pouring, and current machinery is unable to guarantee an orientation of the spout when placing the spout on the can.

However the end user may not realize that the spout needs to be oriented before pouring, or may find it inconvenient or difficult to reorient the spout or may not choose the correct direction. Nevertheless, cans are generally shaped so that pouring can only be successful from a certain direction.

Also for a smooth pour, especially with a viscous liquid, the end of the spout needs to be a certain distance from the body of the container, otherwise the liquid spreads to the body of the container instead of pouring.

The present embodiments address the above issues.

SUMMARY OF THE INVENTION

The present embodiments provide a structure that separates air flow from liquid flow as the liquid is poured out of the container and air flows back to take the place of the outgoing liquid. Separation of the air flow may provide management of bubble formation.

According to an aspect of some embodiments of the present invention there is provided a liquid pourer for a container of liquid, comprising:

a spout; and a liquid uptake structure aligned to provide liquid to the spout, the liquid uptake structure having a first end towards the spout and a second end towards a depth of the container, the structure comprising:

first openings radially distributed around the structure at the first end;

second openings radially distributed around the structure at the second end; and a third opening centrally located at the second end, the liquid uptake structure thereby to provide an airflow path through the second openings and a principle liquid flow path separate from the airflow path through the third opening.

In an embodiment, the second openings comprise gaps between extensions radially distributed around the structure and extending towards the second end.

In an embodiment, the liquid uptake structure further comprises a ring radially inwards of the extensions to define a radial separation between the airflow path and the liquid path.

In an embodiment, the extensions are longitudinal fins arranged cylindrically and the airflow openings are slits between the fins.

In an embodiment, the first openings comprise slits in the cylinder towards the upper end.

In an embodiment, liquid flow into the spout is from some of the first openings, from between the extensions and the ring and from within the ring and bubble formation is outside of the extensions and between the ring and the extensions.

In an embodiment, liquid flow into the spout is from some of the first openings, from submerged ones of the second openings and from the third opening and bubble formation is outside of non-submerged ones of the second openings.

In an embodiment, the spout is a telescopic spout comprising at least two telescopic spout parts. In other embodiments the spout may be a single piece spout.

In an embodiment, the telescopic spout is tensioned to extend upon opening, for example with a tensioning means, in particular a coiled spring.

In an embodiment, an end of the telescopic spout is connected to a cap such as to be pulled to an extended position upon opening of the cap.

In an embodiment, the telescopic spout comprises a body for attaching to an opening in a liquid container, a first telescoping part and a second telescoping part, the body holding the telescoping spout parts in line with the liquid uptake structure and further comprising a rim for fitting onto an opening in the container.

In an embodiment, the rim comprises a snap fit structure.

In an embodiment, the snap fit structure comprises an upper rim part extending radially beyond the opening, a wall extending radially to fit tightly within the opening and a lower rim extending beyond the wall to fit past the opening in a snapping movement and to prevent easy removal from the opening.

According to a second aspect of the present invention there is provided a method of manufacturing a liquid pourer for smoothly dispensing liquid from a container via a single opening, the method comprising:

providing a liquid path for passage of liquid centrally through the pourer; and providing an air path for passage of air and bubble formation radially outwardly of the liquid path.

The method may comprise providing a cylinder surrounding the liquid path and having airflow openings radially distributed in the cylinder.

The method may comprise providing a radial thickness between the air path and the liquid path.

According to a third aspect of the present invention there is provided a container having a liquid pourer of the kind described above, the container being an aluminium can, a jerrycan, a bottle, or any other kind of liquid container and/or may be square, rectangular, or cylindrical in cross section.

According to a fourth aspect of the present invention there is provided a method of providing a smooth pour liquid container comprising obtaining a liquid pourer manufactured as described above, and attaching the liquid pourer to a liquid container.

According to a fifth aspect of the present invention there is provided a method of smoothly pouring a liquid, comprising obtaining a liquid container having a liquid pourer as described above, opening the pourer and pouring the liquid.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

DESCRIPTION OF THE SEVERAL VIEWS OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF SPECIFIC EMBODIMENTS OF THE INVENTION

Figure 1A:
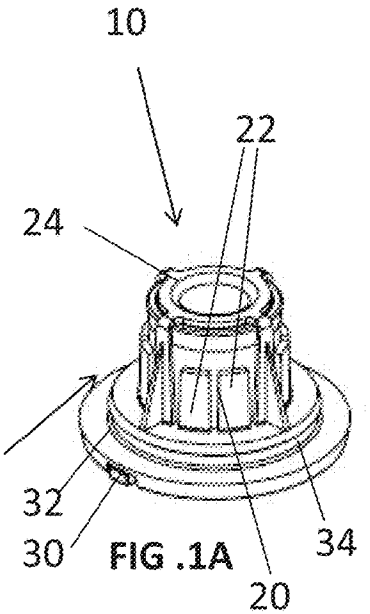
FIGS. 1A, 1B, 1C, 1D, 1E and 1F are simplified schematic views of a liquid pourer of the present embodiments with the spout in the closed position.
Figure 1B:
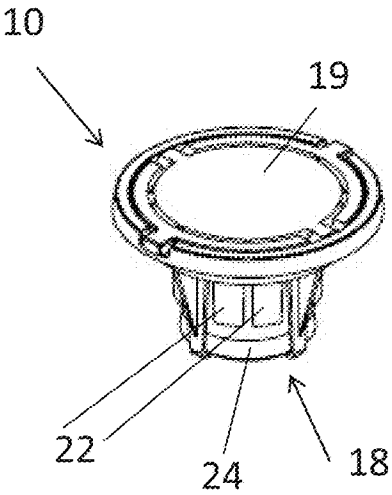
Figure 1C:
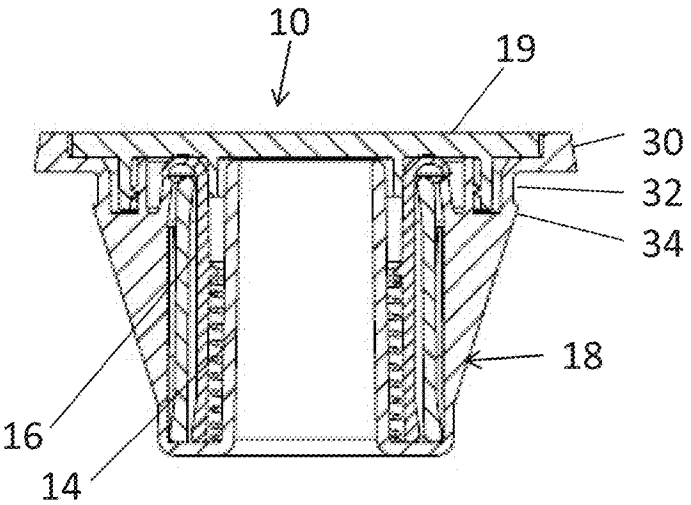
Figure 1D:
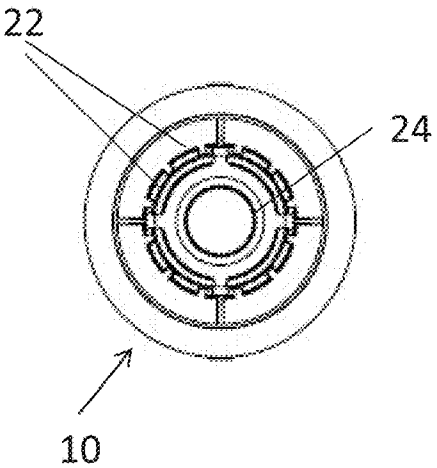
Figure 1E:
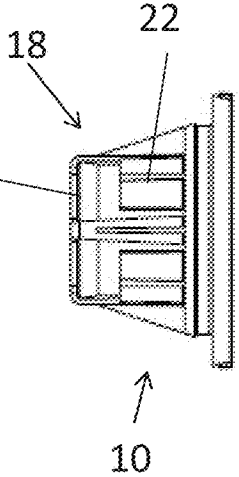
Figure 1F:
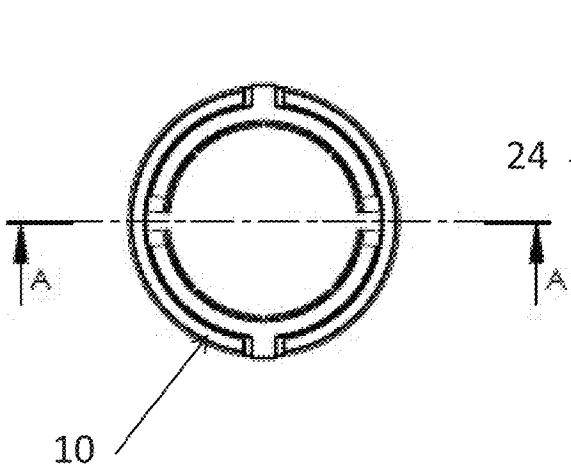
Figures 2A, 2B, 2C, 2D, 2E, 2F:
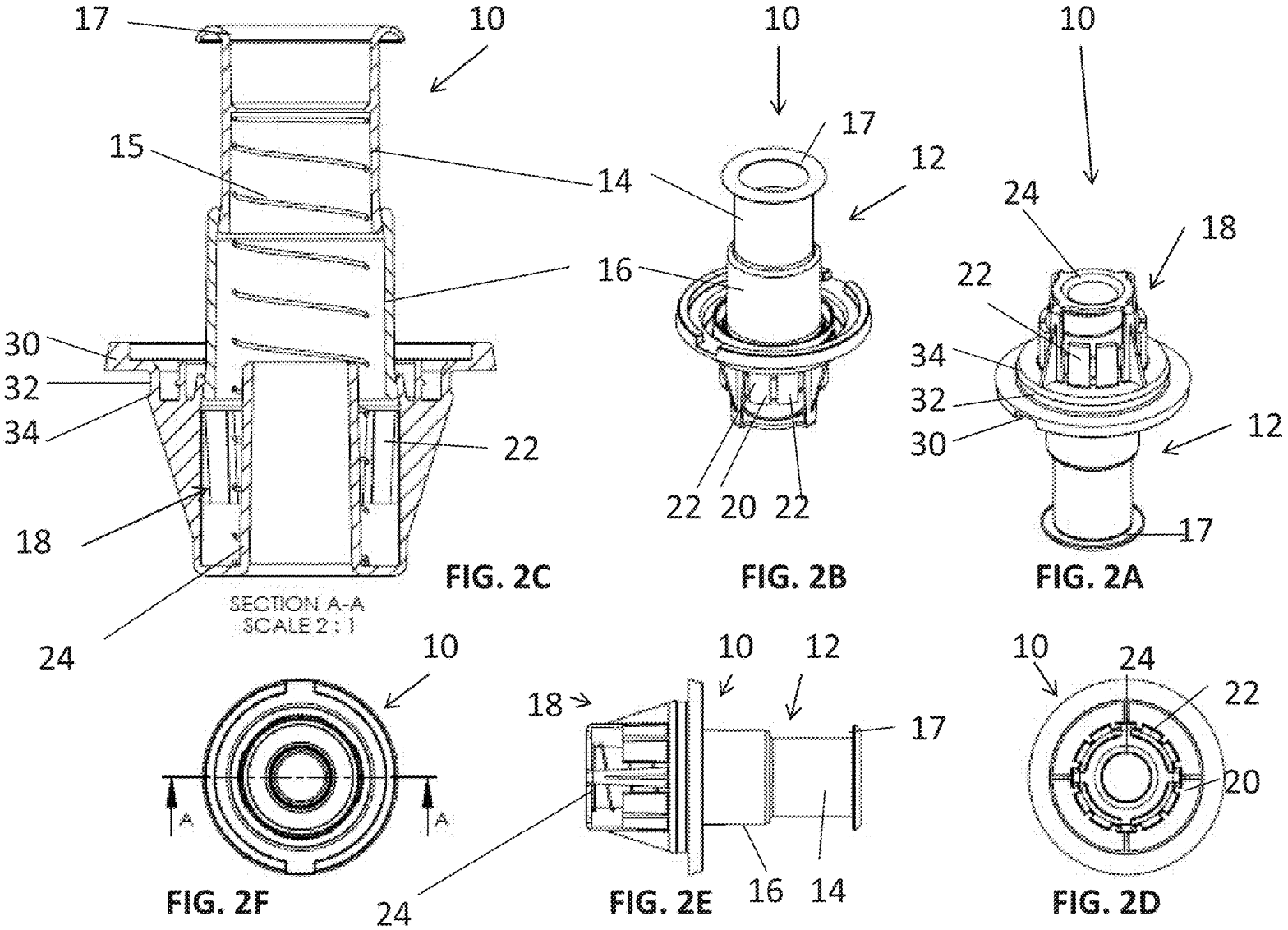
FIGS. 2A, 2B, 2C, 2D, 2E and 2F are simplified schematic views of a liquid pourer of the embodiment of FIGS. 1A to 1F with the spout in the open position.

The present invention, in some embodiments thereof, relates to a smooth pour directionless spout and, more particularly, but not exclusively, to such a spout that is easy to mould and which can be fixed onto cans or bottles using legacy machinery.

A liquid pourer, which can be attached to cans, jerry cans, bottles etc, comprises a spout and a liquid uptake structure aligned to provide liquid to the spout from a container. A liquid uptake structure is aligned to provide liquid from the container to the spout and has first openings radially distributed at the spout end, second openings radially distributed around the container end and a third opening centrally located at the container end. The liquid uptake structure provides an airflow path through the second openings and a principle liquid flow path separate from the airflow path through the third opening, thus separating the two flow paths and providing a smooth pour.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Figure 3:
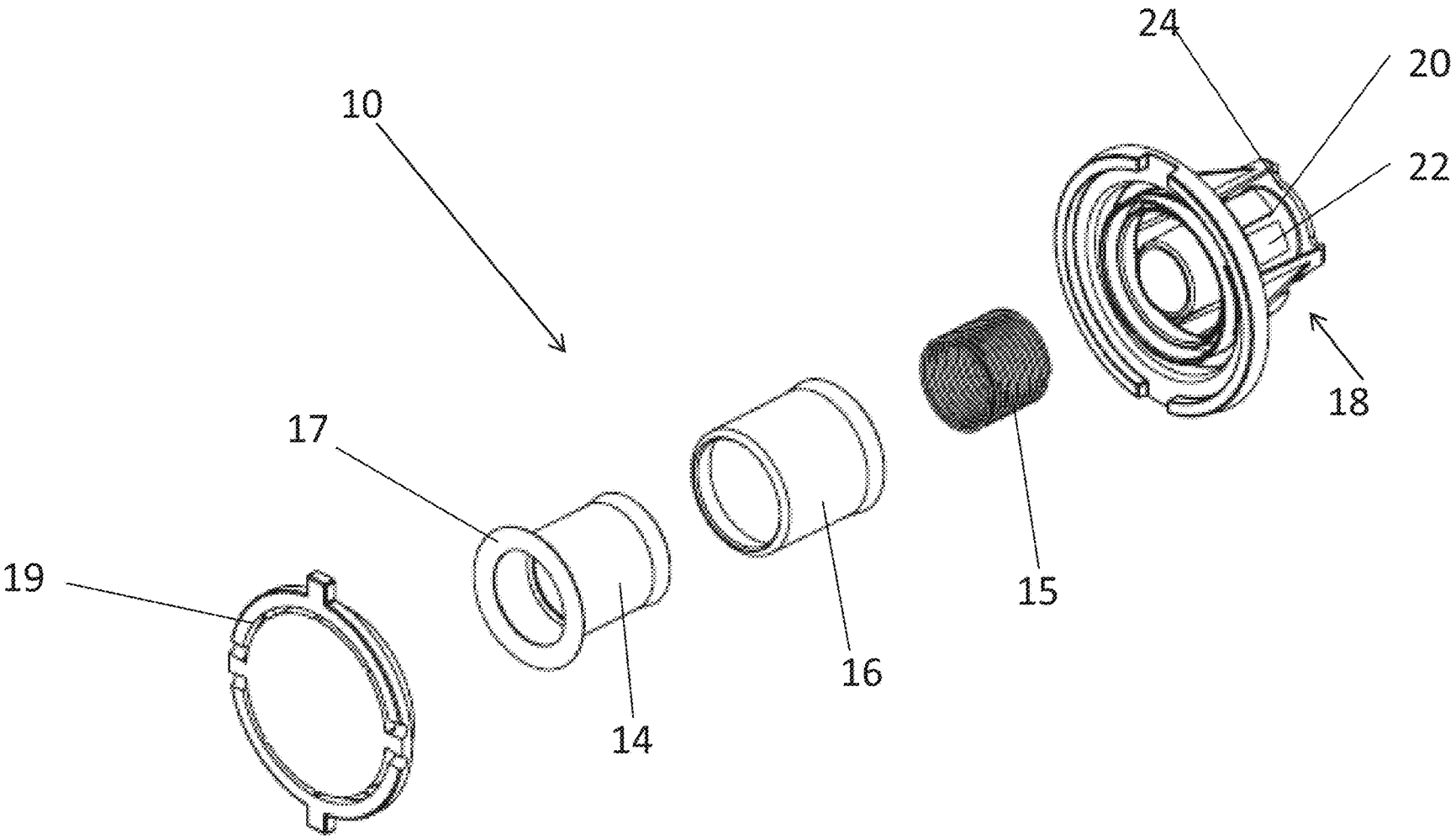
FIG. 3 is a simplified exploded diagram of a liquid pourer according to the of the embodiment of FIGS. 1A to 1F.

Referring now to the drawings, FIGS. 1A-1F illustrate a liquid uptake structure in an extended position from different angles and including a cross section. FIGS. 2A-2F show the same liquid uptake structure in a contracted state, and FIG. 3 is an exploded diagram of the liquid uptake structure. The same part numbers are used throughout the figures.

A liquid dispenser or pourer 10 is designed to be fixed into openings in cans or bottles, and is intended to direct liquid smoothly out of the container in a smooth pour without causing jumps or interruptions. The smooth pour may be achieved by the way in which air is introduced into the container to replace the exiting liquid.

The dispenser may comprise a telescopic spout 12 that includes two telescoping sections 14 and 16. Spring 15 may be located to tension the spout parts to separate. Alternatively upper flange 17 of upper spout section 14 may be engaged within cap 19 so that the spout is opened by removing the cap. As a further alternative the spout may be made of a single part.

A liquid uptake structure 18 is aligned with the spout to direct liquid from the container into spout 12, as will be described in greater detail below. The structure comprises airflow openings 20 radially distributed around the structure and extensions 22 radially distributed around the structure and extending towards the interior of the container to guide airflow and thus bubble formation away from the liquid path. In the embodiment illustrated in FIGS. 1A-3 the extensions 22 are in the form of teeth or fins and the airflow openings 20 are gaps or slits between the teeth. In other embodiments the extensions may be continuous around the structure, forming a cylinder, and the airflow openings may be openings or holes in the extensions.

The liquid uptake structure 18 may further include a ring 24 facing towards the interior of the container, located radially inward of the extensions. The ring 24 may be located adjacent to the ends of the extensions or inwardly towards the interior of the container or further out towards the spout. Ring 24 provides a barrier preventing bubbles forming over the extensions 22 from reaching and thus blocking the flow path inside the ring, and thus prevents the gurgling effect well known with pouring from bottles. The gurgling effect is generally caused by air entering to replace the poured liquid and forming bubbles which temporarily stop the pour and then burst.

That is to say, liquid flow into the spout is from whichever of the openings or slits are lower down, from the gap between the extensions and the ring and from within the ring. Air, on the other hand, flows through the slits or openings on the upper side, and forms bubbles away around the ends of the extensions. The bubbles try to extend towards the middle but encounter the ring, whose edge acts to limit further extension of the bubble. Thus bubble formation is restricted to the area radially outside of the extensions and between the ring and the extensions but is prevented from extending inside the ring.

Telescoping section 16 supports spout 12 in line with liquid uptake structure 18 and further includes a stepped construction 28 for fitting onto an opening in the container. The embodiment illustrated is designed for insertion into a can. The stepped construction includes an outer rim 30, a step 32 and a snap fit lip 34 which prevents the dispenser from being easily removed once fitted.

Figure 4:
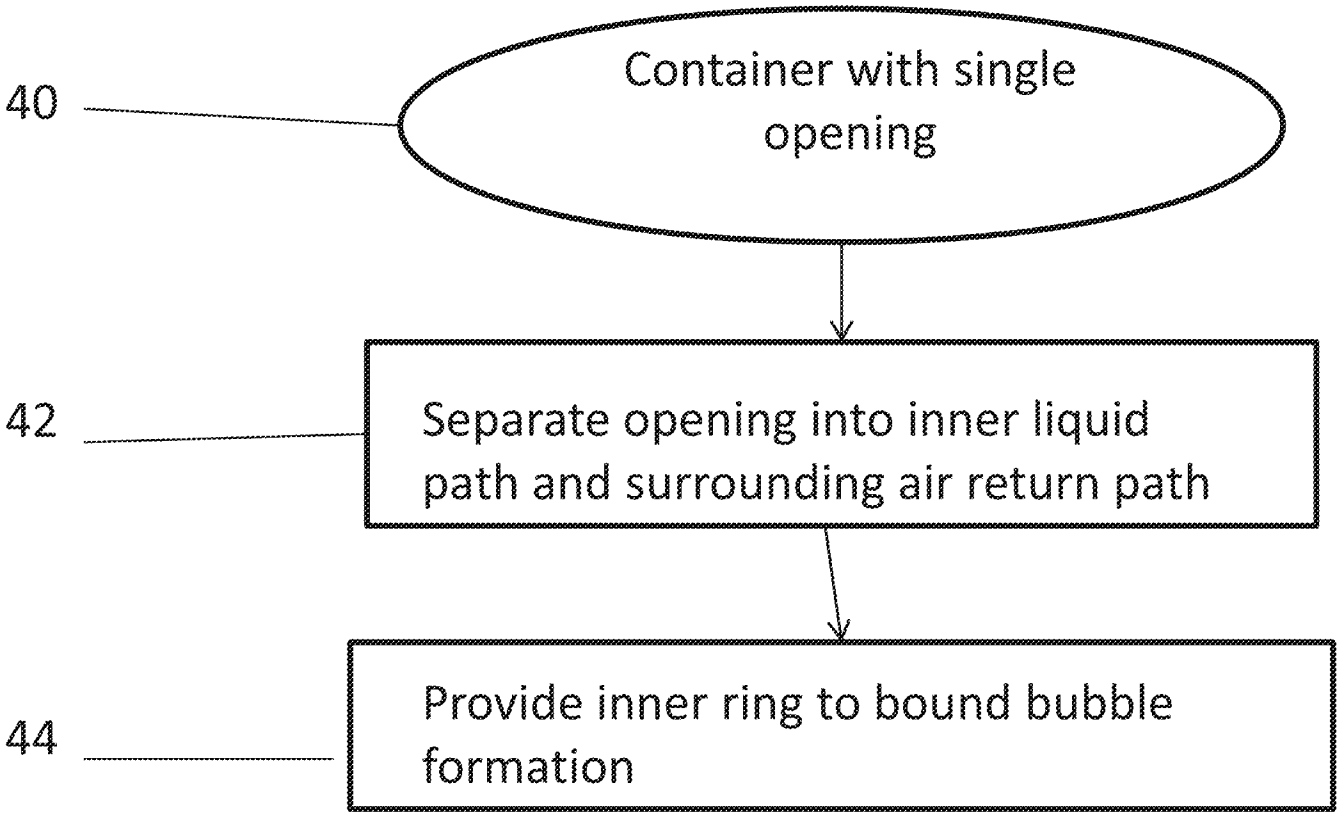
FIG. 4 is a simplified flow chart of a process of manufacturing the pourer.

Reference is now made to FIG. 4, which is a simplified flow chart showing a method of smoothly dispensing liquid from a container via a single opening which comprises separating the opening into separate liquid and air return paths. The container with a single opening is provided 40, which is then divided 42 using a first circumferential divider into the separate paths, so that the air return path extends circumferentially around the liquid path, although of course air only flows on the side not occupied by the liquid. The air return path is liable to bubble formation, so that a second, radially separated inner ring is provided 44 concentrically inwardly of the circumferential divider to provide a bubble formation edge. The inner ring provides an inner extent beyond which the end of the bubble is prevented from passing. The outer edge of the bubble is rather caused to cling to the inner ring as a point of minimal energy, thus making sure that the bubbles do not interfere with the passage of liquid. As discussed, the outer cylindrical divider comprises a cylindrical extension surrounding the liquid path and having openings radially distributed around the ring, either as slits or as holes, to form part of the air passage.

Figure 5:
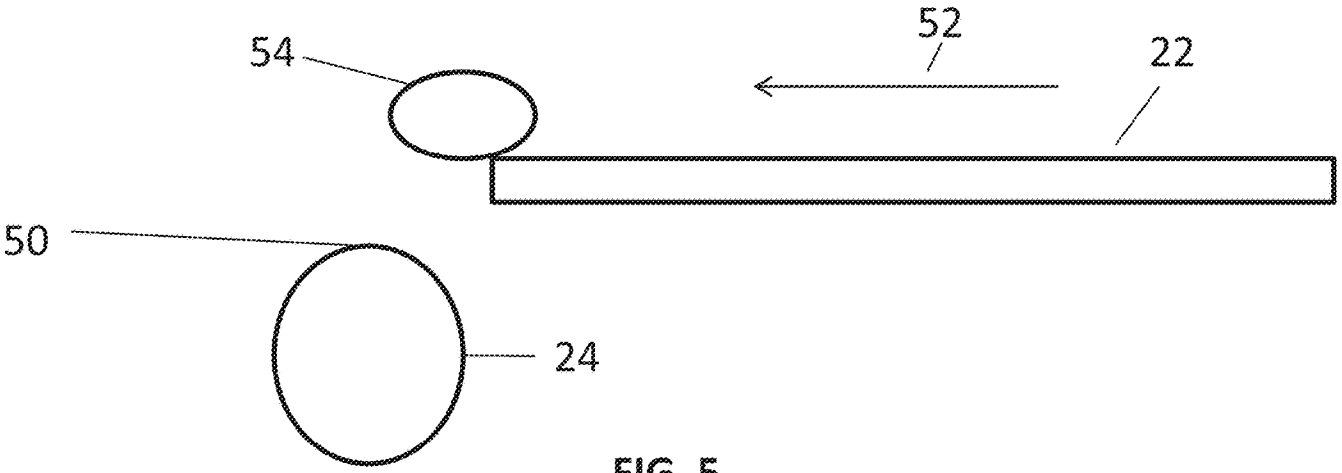
FIGS. 5 and 6 are simplified diagrams explaining bubble formation in a pourer according to the present embodiments.
Figure 6:
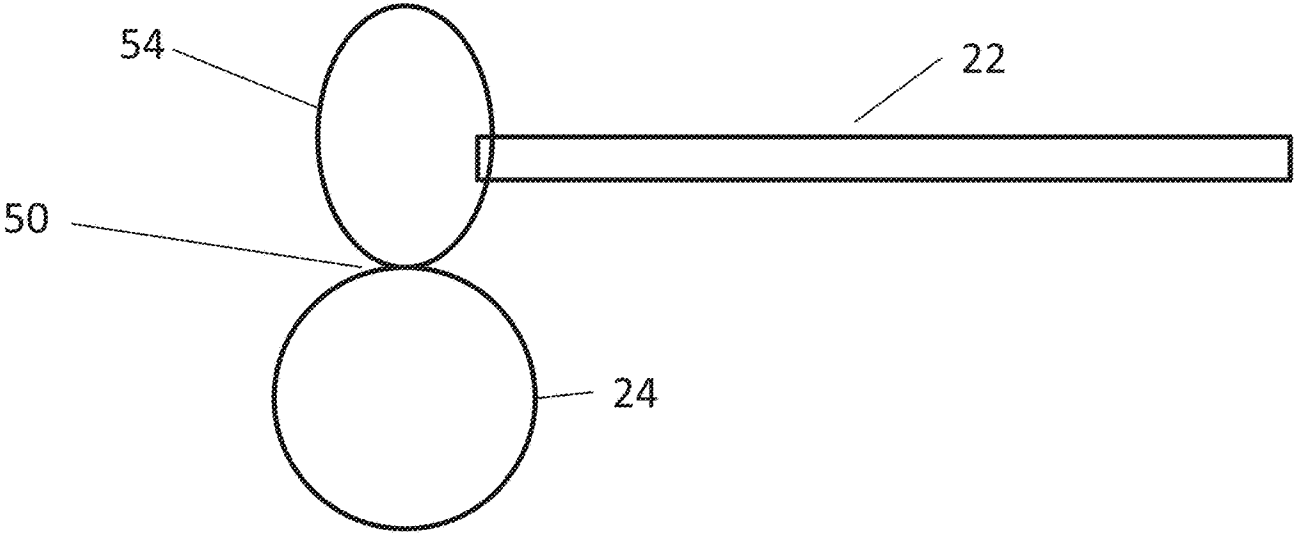

FIGS. 5 and 6 schematically illustrate bubble formation between extension 22 of the first circumferential divider and edge 50 of ring 24.

In FIG. 5 air flowing in the direction of arrow 52 emerges from openings 20, and a bubble 54 begins to form, typically towards the end of the edge.

In FIG. 6 the bubble 54 grows outwardly towards the center of the flow path of the liquid, but bubble growth is arrested by edge 50, and does not substantially enter the region within the ring 24. The effect is to prevent the bubble from interfering with flow and thus does away with the familiar gurgling sound of liquid pouring from a container.

Figure 7:
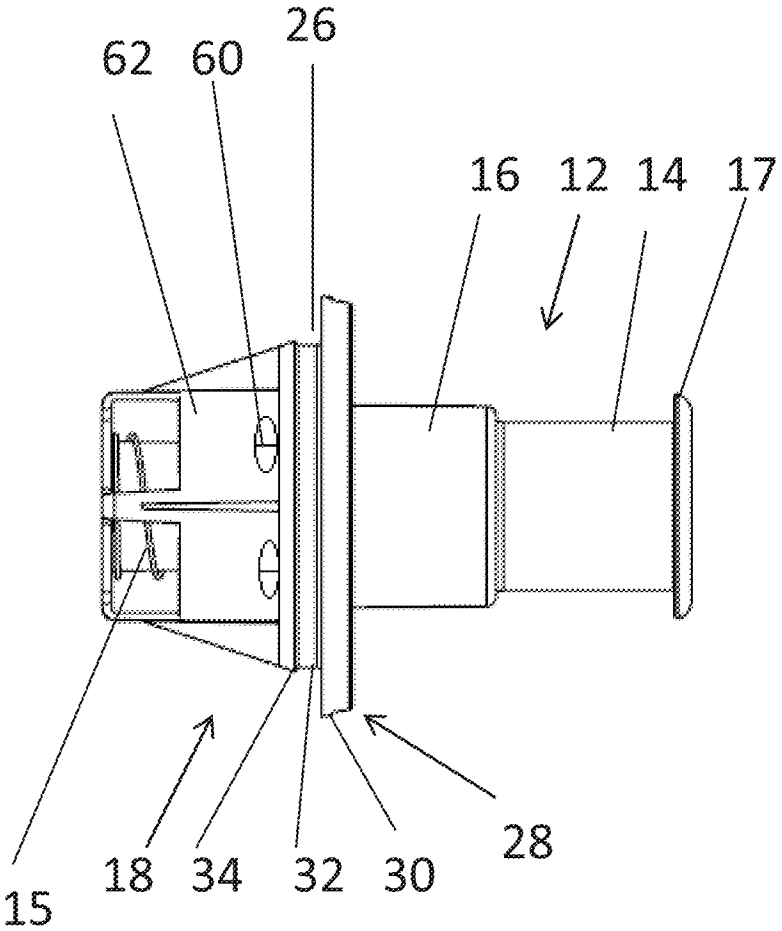
FIG. 7 is a simplified diagram illustrating a pourer according to the present embodiments wherein the air openings are holes.
Figure 8A:
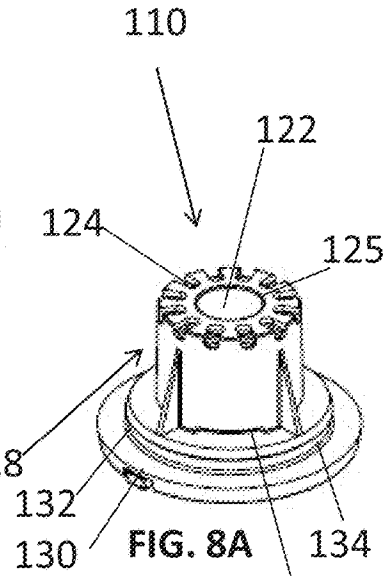
FIGS. 8A, 8B, 8C, 8D, 8E and 8F are simplified schematic views of a liquid pourer of a further embodiment of the present invention with the spout in the closed position.
Figure 8B:
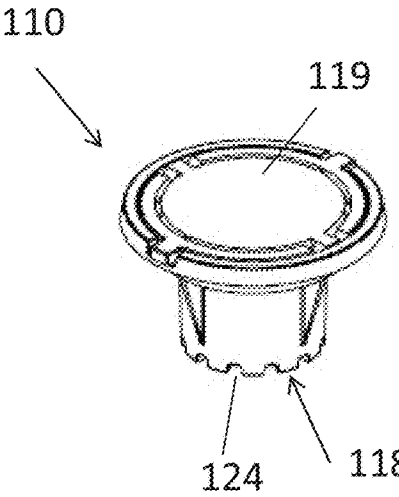
Figure 8C:
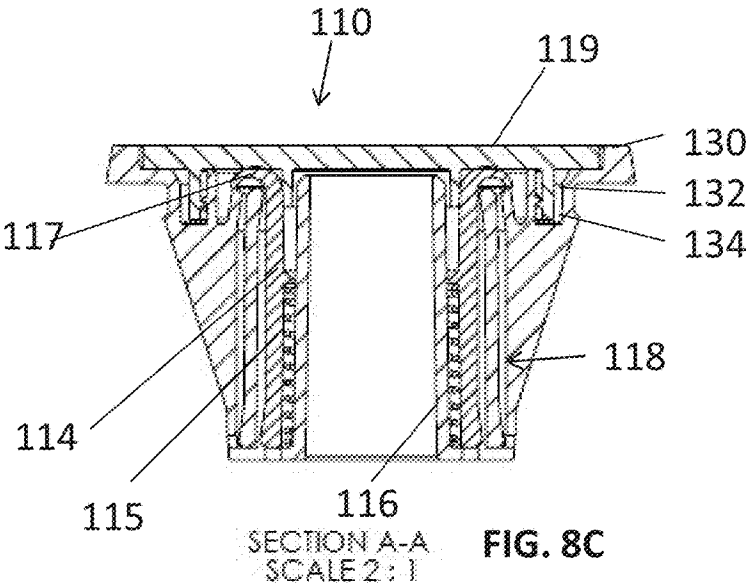
Figure 8D:
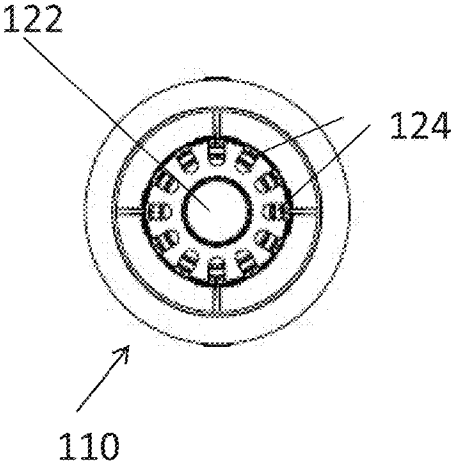
Figure 8E:
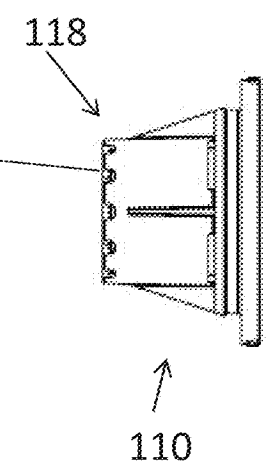
Figure 8F:
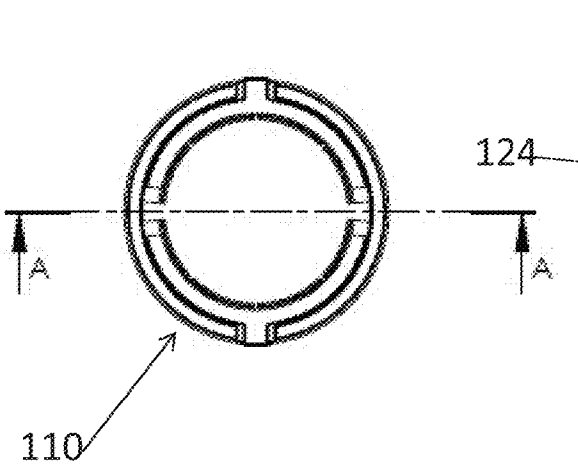
Figure 9A:
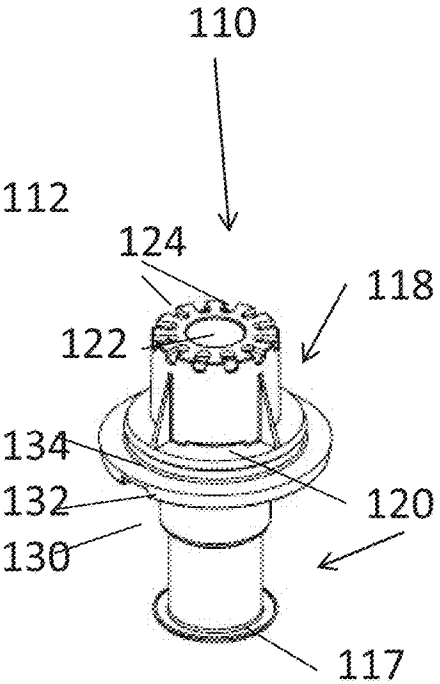
FIGS. 9A, 9B, 9C, 9D, 9E and 9F are simplified schematic views of a liquid pourer of the embodiment of FIGS. 8A to 8F with the spout in the open position.
Figure 9B:
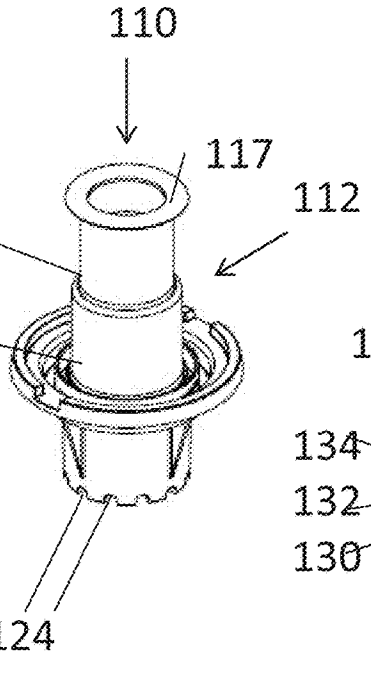
Figure 9C:
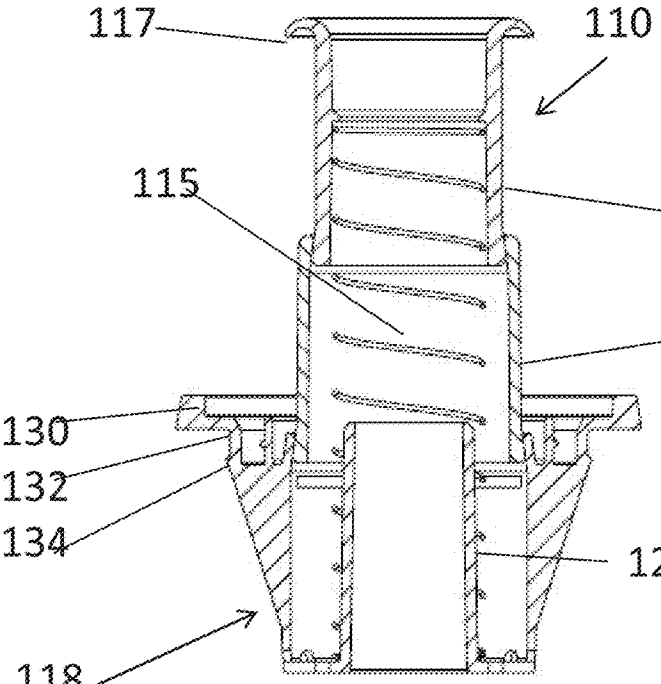
Figure 9D:
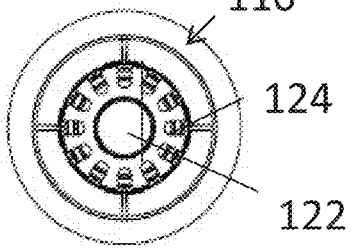
Figure 9E:
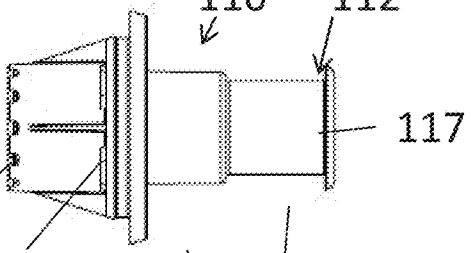
Figure 9F:
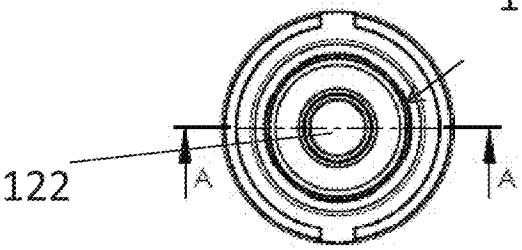

Reference is now made to FIG. 7, which is a simplified diagram illustrating an embodiment of the present invention in which the airflow openings 20 for allowing the air to circulate are holes 60 in a continuous outer cylinder structure 62. The continuous outer cylinder structure replaces the extensions 22 of the previous embodiments. The remainder of the structure is the same as in the previous embodiments and is given the same reference numerals.

Figure 10:
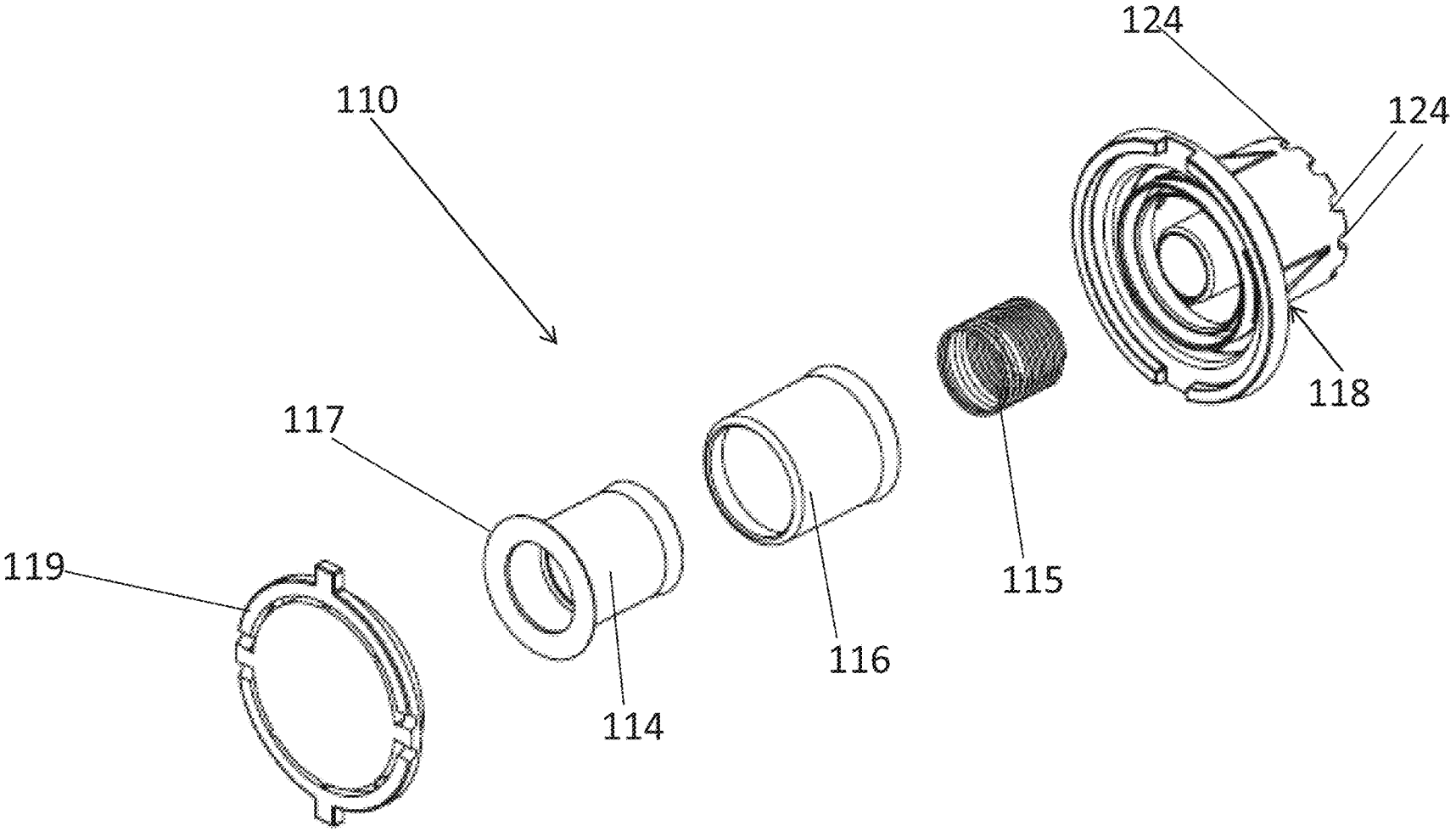
FIG. 10 is a simplified exploded diagram of a liquid pourer according to the embodiment of FIGS. 8A to 8F.

FIGS. 8A-8F illustrate a liquid uptake structure according to a further embodiment of the present invention. The embodiment is shown in FIGS. 8A-8F in an extended position from different angles and including a cross section. FIGS. 9A-9F show the same liquid uptake structure in a contracted state, and FIG. 10 is an exploded diagram of the liquid uptake structure. The same part numbers are used throughout the figures.

A liquid dispenser or pourer 110 is designed to be fixed into openings in cans or bottles, and is intended to direct liquid smoothly out of the container in a smooth pour without causing jumps or interruptions. As with the previous embodiment, the smooth pour may be achieved by the way in which air is introduced into the container to replace the exiting liquid.

The dispenser may comprise a telescopic spout 112 that includes two telescoping sections 114 and 116. Spring 115 may be located to tension the spout parts to separate. Alternatively upper flange 117 of upper spout section 114 may be engaged within cap 119 so that the spout is opened by removing the cap.

A liquid uptake structure 118 is aligned with the spout to direct liquid from the container into spout 112, as will be described in greater detail below. The structure comprises basal liquid openings 120 which in the present embodiment are radially distributed around the base of the spout structure, typically in the form of slits. Either water or air can pass through the slits but the width of the slits is too small to allow for bubble formation. A main liquid entry opening 122 at the base of the structure leading centrally towards the interior of the container to guide liquid flow. As the basal liquid openings 120 are too narrow, bubbles are unable to pass through, and thus flow forward to bubble openings 124 distributed radially around the end of the spout that is at least partly immersed in the liquid being drawn. The bubble openings 124 are smaller than in the embodiment of FIGS. 1A-1F and thus the bubbles which escape through them are smaller and less prone to disrupt smooth liquid flow. The radial holes allow for the bubbles to escape towards the radial edge of the spout and thus the airflow and bubbles are kept away from the main liquid path.

The liquid uptake structure 118 may further include a radial thickness 125 located inward of the bubble openings 124 and defining a radial separation between central opening 122 and the bubble openings 124. The ring 125 may be located adjacent to the ends of the bubble openings. Ring 125 provides a barrier preventing bubbles forming over the extensions 22 from reaching and thus blocking the flow path inside the ring, and thus prevents the gurgling effect well known with pouring from bottles. The gurgling effect is generally caused by air entering to replace the poured liquid and forming bubbles which temporarily stop the pour and then burst.

That is to say, liquid flow into the spout is from whichever of the openings or slits are lower down, from the gap between the extensions and the ring and from within the ring. Air, on the other hand, flows through the bubble openings 124 and forms bubbles away around the main liquid flow through opening 122. The ring 125 acts as a barrier and although the bubbles can reach inward, they have little effect within the radius of ring 125. Thus bubble formation is restricted away from the main liquid flow.

Telescoping section 116 supports spout 112 in line with liquid uptake structure 118 and further includes a stepped construction 128 for fitting onto an opening in the container. The embodiment illustrated is designed for insertion into a can. The stepped construction includes an outer rim 130, a step 132 and a snap fit lip 134 which prevents the dispenser from being easily removed once fitted.

As well as aluminum or tin cans, the pourer is suitable for any liquid container that requires pouring, including jerrycans, bottles, liquid dispensers and the like. The pourer provides a clear path for the liquid being poured and a clear path for the air that needs to replace the poured liquid, wherein the liquid and the air paths do not interfere with each other. The pourer may provide a smooth pour with minimal splashing or dripping, and prevention of gurgling.

It is expected that during the life of a patent maturing from this application many relevant liquid containers and liquid feeding systems will be developed and the scopes of the corresponding terms are intended to include all such new technologies a priori.

The terms "comprises", "comprising", "includes", "including", "having" and their conjugates mean "including but not limited to".

The term "consisting of" means "including and limited to".

As used herein, the singular form "a", "an" and "the" include plural references unless the context clearly dictates otherwise.

It is appreciated that certain features of the invention, which are, for clarity, described in the context of separate embodiments, may also be provided in combination in a single embodiment, and the above description is to be construed as if this combination were explicitly written. Conversely, various features of the invention, which are, for brevity, described in the context of a single embodiment, may also be provided separately or in any suitable subcombination or as suitable in any other described embodiment of the invention, and the above description is to be construed as if these separate embodiments were explicitly written. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A liquid pourer for a container of liquid, comprising:
a telescopic spout; and
a liquid uptake structure aligned to provide liquid to said spout, said liquid uptake structure having a first end towards said spout and a second end towards a depth of said container, the structure comprising:
cylindrically distributed extensions extending downwardly from said first end and terminating prior to reaching said second end, and having first openings extending downwardly between said extensions, said first openings thereby forming slits, said first openings being open towards said second end to form a second, circumferential opening;
a ring located radially inwardly of said extensions and beyond said terminating, said ring forming a third opening within said ring at said second end, the liquid uptake structure thereby to provide an airflow path through said first openings and said second opening and a principle liquid flow path separate from said airflow path through said third opening; said ring defining a radial separation between said airflow path and said liquid path, said separated airflow path surrounding said liquid path and extending towards said extensions and said gaps; and
a rim for fixing onto an opening in a container.

2. The liquid pourer of claim 1, wherein said extensions comprise longitudinal fins arranged cylindrically and said first openings are slits between said fins.

3. The liquid pourer of claim 1, wherein said slits are arranged cylindrically around said structure towards said upper end.

4. The liquid pourer of claim 1, wherein liquid flow into said spout is from some of said first openings, from between said teeth and said ring and from within said ring and wherein a region of bubble formation is formed outside of said extensions and between said ring and said extensions.

5. The liquid pourer of claim 1, wherein liquid flow into said spout is from some of said first openings, from submerged parts of said second opening and from said third opening and wherein bubble formation is outside of non-submerged parts of said second opening.

6. The liquid pourer of claim 1, wherein said spout is a telescopic spout comprising at least two telescopic spout parts.

7. The liquid pourer of claim 6, wherein said telescopic spout is tensioned to extend upon opening.

8. The liquid pourer of claim 6, wherein an end of said telescopic spout is connected to a cap such as to be pulled to an extended position upon opening of said cap.

9. The liquid pourer of claim 1, wherein said telescopic spout comprises a first telescoping part and a second telescoping part.

10. The liquid pourer of claim 9, wherein said rim comprises a snap fit structure.

11. The liquid pourer of claim 10, wherein said snap fit structure comprises an upper rim part extending radially beyond said opening, a wall extending radially to fit tightly within said opening and a lower rim extending beyond said wall to fit past said opening in a snapping movement and to prevent easy removal from said opening.

12. A container having a liquid pourer according to claim 1.

13. A method of smoothly pouring a liquid, comprising obtaining a liquid container having a liquid pourer according to claim 1, opening said pourer and pouring said liquid.

14. A method of manufacturing a liquid pourer for smoothly dispensing liquid from a container via a single opening, the method comprising:

providing a liquid path for passage of liquid centrally through said pourer;

providing an air path for passage of air and bubble formation radially outwardly of said liquid path, the air path comprising a cylinder surrounding said liquid path and having airflow openings radially distributed in said cylinder between extensions at an upper end, the extensions terminating prior to reaching a lower end, the air path being separated from said liquid path by a ring at said second end, the ring being radially inwardly of said extensions and providing a radial thickness between said air path and said liquid path and further defining a circumferential opening between said ring and a point at which said extensions terminate, said airflow openings opening out into said circumferential opening; and providing a rim for fitting onto said opening in said container, said rim being continuous with said cylinder and said extensions.

15. A method of providing a smooth pour liquid container comprising obtaining a liquid pourer manufactured according to claim 14, and attaching said liquid pourer to a liquid container.

* * * * *